US005439012A

United States Patent [19]

D'Agostino

[11] Patent Number: 5,439,012

[45] Date of Patent: Aug. 8, 1995

[54] APPARATUS FOR REMOVING NAIL POLISH WHILE PRECLUDING CONTACT WITH HARSH CHEMICALS AND SKIN IRRITANTS

[76] Inventor: Carole L. D'Agostino, 6 E. Patcong Ave., Linwood, N.J. 08221

[21] Appl. No.: 303,517

[22] Filed: Sep. 9, 1994

[51] Int. Cl.[6] ..... A45D 29/17; B25B 9/00

[52] U.S. Cl. ..... 132/73; 294/992; 606/210

[58] Field of Search ..... 132/285, 75.3, 73; 294/99.2; 606/206, 210

[56] References Cited

U.S. PATENT DOCUMENTS

| | | | |
|---|---|---|---|
| D. 285,518 | 9/1986 | Hollinshead | 294/99.2 |
| 1,370,818 | 3/1921 | Joerges | 132/73 |
| 1,915,154 | 6/1933 | De Schebeko | 294/99.2 |
| 2,262,977 | 11/1941 | Vasil | 132/285 |
| 4,884,913 | 12/1989 | Smith et al. | 132/73 |
| 4,930,529 | 6/1990 | Whitney | 132/73 |
| 4,938,514 | 7/1990 | D'Addezio | 294/99.2 |

FOREIGN PATENT DOCUMENTS

| | | | |
|---|---|---|---|
| 558526 | 8/1923 | France | 294/99.2 |

*Primary Examiner*—Paul J. Hirsch

[57] ABSTRACT

An apparatus for removing nail polish comprising: a first component of a generally rigid material in an elongated configuration, the first component having an essentially planar lower face and a upper face rounded along its longitudinal axis with a pivot aperture extending laterally through the central extent thereof, the upper surface of the first component being formed with a roughened thumb grip at its leading edge and a roughened finger grip at its trailing edge; a second component of a generally linear extent and fabricated of a rigid material, the second component having a forward planar edge positionable parallel with the forward edge of the first component during operation and use, the second component having a second planar upper surface at an angle with respect to the first planar surface and positionable parallel with the rearward planar surface of the first component when in a compressed orientation, the lower component being formed with a generally curved lower surface with the pair of longitudinally spaced finger receiving regions on its rearward section; and resilient components therebetween.

4 Claims, 4 Drawing Sheets

APPARATUS FOR REMOVING NAIL POLISH WHILE PRECLUDING CONTACT WITH HARSH CHEMICALS AND SKIN IRRITANTS

BACKGROUND OF THE INVENTION

1. Field of the Invention

The present invention relates to an apparatus for removing nail polish while precluding contact with harsh chemicals and skin irritants and more particularly pertains to abating the danger of contacting skin with harsh chemicals and/or skin irritants while removing unwanted nail polish.

2. Description of the Prior Art

The use of apparatuses for holding and manipulating objects from a remote location as well as devices for removing unwanted nail polish is known in the prior art. More specifically, apparatuses for holding and manipulating objects from a remote location as well as devices for removing unwanted nail polish heretofore devised and utilized for the purpose of removing unwanted nail polish through the manipulation from a remote location through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,283,809 discloses a swab holding tool.

U.S. Pat. No. 4,614,008 discloses a spring biased clothes pin.

U.S. Pat. No. 4,940,454 discloses a hygienic swab-type device with extender handle cover.

U.S. Pat. No. 5,147,380 discloses a biopsy forceps device having improved locking means.

U.S. Pat. No. 5,269,790 discloses clip forceps.

In this respect, the apparatus for removing nail polish while precluding contact with harsh chemicals and skin irritants according to the present invention substantially departs from the conventional concepts and designs of the prior art, and in doing so provides an apparatus primarily developed for the purpose of abeting the danger of contacting skin with harsh chemicals and/or skin irritants while removing unwanted nail polish.

Therefore, it can be appreciated that there exists a continuing need for new and improved apparatus for removing nail polish while precluding contact with harsh chemicals and skin irritants which can be used for abate the danger of contacting skin with harsh chemicals and/or skin irritants while removing unwanted nail polish. In this regard, the present invention substantially fulfills this need.

SUMMARY OF THE INVENTION

In view of the foregoing disadvantages inherent in the known types of apparatuses for holding and manipulating objects from a remote location as well as devices for removing unwanted nail polish now present in the prior art, the present invention provides an improved apparatus for removing nail polish while precluding contact with harsh chemicals and skin irritants. As such, the general purpose of the present invention, which will be described subsequently in greater detail, is to provide a new and improved apparatus for removing nail polish while precluding contact with harsh chemicals and skin irritants and method which has all the advantages of the prior art and none of the disadvantages.

To attain this, the present invention essentially comprises a new and improved apparatus for removing nail polish while precluding contact with harsh chemicals and skin irritants comprising, in combination a first upper component fabricated of a generally rigid material in an elongated configuration, the first component having an essentially planar lower face and a upper face rounded along its longitudinal axis with a pivot aperture extending laterally through the central extent thereof to form a forward extent and a rearward extent, the upper face of the first component being formed with a roughened thumb grip at the rearward end of the rearward extent and a roughened finger grip at a central portion of the forward extent; a second lower component of a generally linear configuration and fabricated of a generally rigid material, the second component having leading and trailing edges positionable parallel with the leading and trailing edges of the first component during operation and use, the second component having a pivot aperture extending laterally through a central extent thereof to form a forward extent and a rearward extent and with planar upper surfaces formed on the forward and rearward extents with at an angle of between about ten and twenty degrees formed with respect to the extents, the forward extent being positionable parallel with the lower surface of the upper component when in a relaxed orientation, the rearward extent positioned parallel with the lower surface of the upper component when in the compressed orientation. The lower surface of the rearward extent being formed with a generally curved lower surface with a pair of longitudinally spaced finger receiving regions; a coil spring with a central coil and a first linear member and second linear member oppositely spaced, the first linear member being positioned on the upper surface of the rearward extent of the second component and the second linear member positioned on the upper surface at the forward extent of the first component with an attachment plate securing the linear members of the spring to the component; and removable attachment means extending through the pivot apertures of the first and second components and the central coil of the spring whereby compressing together the rearward extents of the first and second components will open the forward extents of the first and second components against the resilient urging of the spring while release of the pressure from the rearward extents of the first and second components will allow the return of the forward extents of the first and second components for grasping an object for the remote manipulation thereof.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for removing nail polish while precluding contact with harsh chemicals and skin irritants which have all the advantages of the prior art apparatuses for holding and manipulating objects from a remote location as well as devices for removing unwanted nail polish and none of the disadvantages.

It is another object of the present invention to provide a new and improved apparatus for removing nail polish while precluding contact with harsh chemicals and skin irritants which may be easily and efficiently manufactured and marketed.

It is further object of the present invention to provide a new and improved apparatus for removing nail polish while precluding contact with harsh chemicals and skin irritants which is of durable and reliable construction.

An even further object of the present invention is to provide a new and improved apparatus for removing nail polish while precluding contact with harsh chemicals and skin irritants which is susceptible of a low cost of manufacture with regard to both materials and labor, and which accordingly is then susceptible of low prices of sale to the consuming public, thereby making such apparatus for removing nail polish while precluding contact with harsh chemicals and skin irritants economically available to the buying public.

Still yet another object of the present invention is to provide a new and improved apparatus for removing nail polish while precluding contact with harsh chemicals and skin irritants which provide in the apparatuses and methods of the prior art some of the advantages thereof, while simultaneously overcoming some of the disadvantages normally associated therewith.

Still another object of the present invention is to abate the danger of contacting skin with harsh chemicals and/or skin irritants while removing unwanted nail polish.

Lastly, it is an object of the present invention to provide a new and improved apparatus for removing nail polish comprising a first component of a generally rigid material in an elongated configuration, the first component having an essentially planar lower face and a upper face rounded along its longitudinal axis with a pivot aperture extending laterally through the central extent thereof, the upper surface of the first component being formed with a roughened thumb grip at its leading edge and a roughened finger grip at its trailing edge; a second component of a generally linear extent and fabricated of a rigid material, the second component having a forward planar edge positionable parallel with the forward edge of the first component during operation and use, the second component having a second planar upper surface at an angle with respect to the first planar surface and positionable parallel with the rearward planar surface of the first component when in a compressed orientation, the lower component being formed with a generally curved lower surface with the pair of longitudinally spaced finger receiving regions on its rearward section; and resilient components therebetween.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
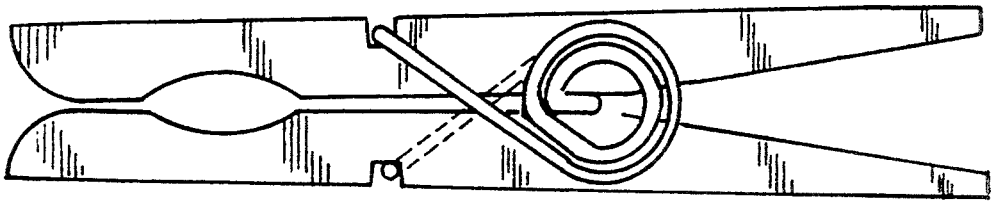
FIG 1 PRIOR ART
FIG. 1 is a side elevational view of a prior art device for holding devices at a location remote from the end when the device is manipulated.
Figure 2:
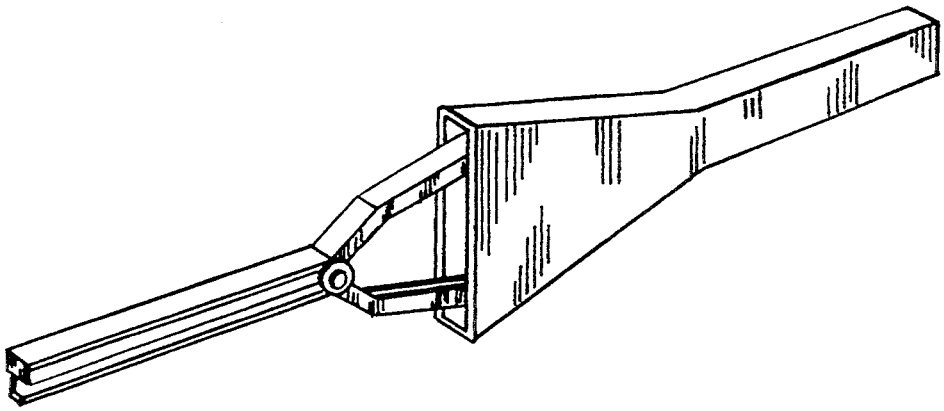
FIG 2 PRIOR ART
FIG. 2 is a perspective view of another prior device for manipulating material from a remote location.
Figure 4:
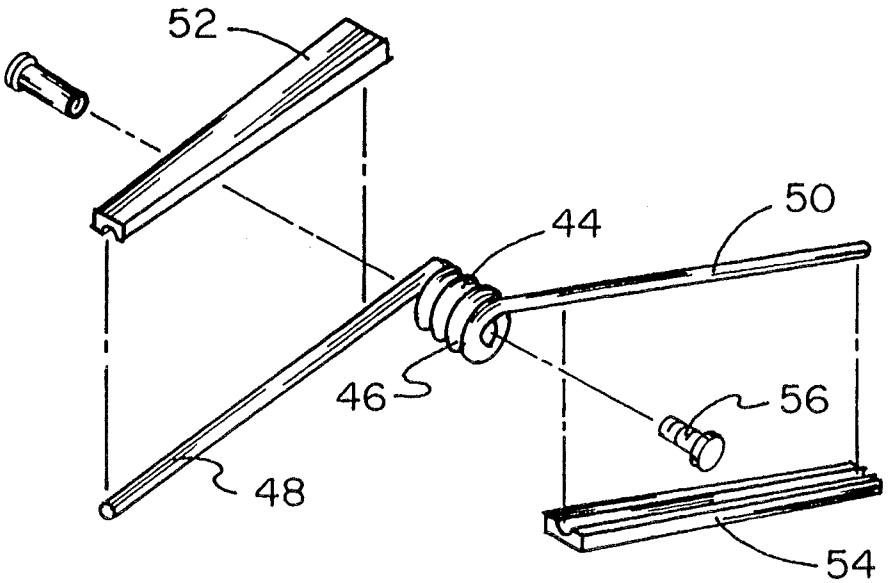
FIG. 4 is an exploded perspective illustration of the resilient operating components of the device shown in FIG. 3.
Figure 3:
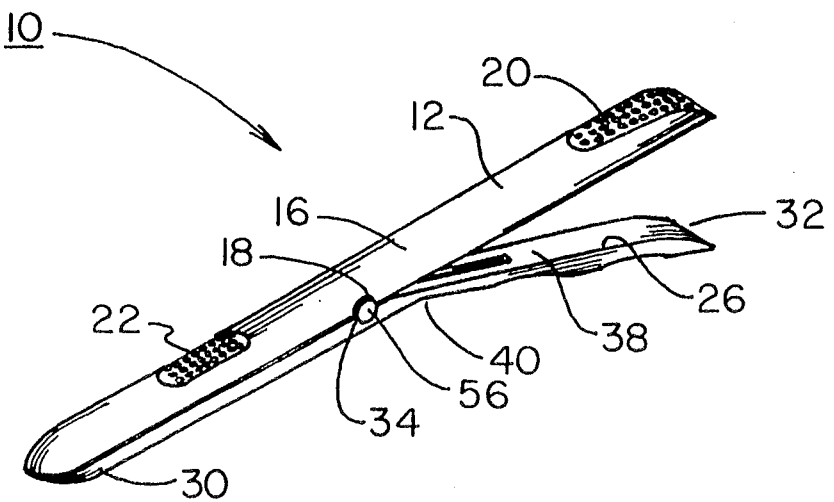
FIG. 3 is a perspective illustration of the preferred embodiment of the new and improved apparatus for removing nail polish while precluding contact with harsh chemicals and skin irritants constructed in accordance with the principles of the present invention.
Figure 5:
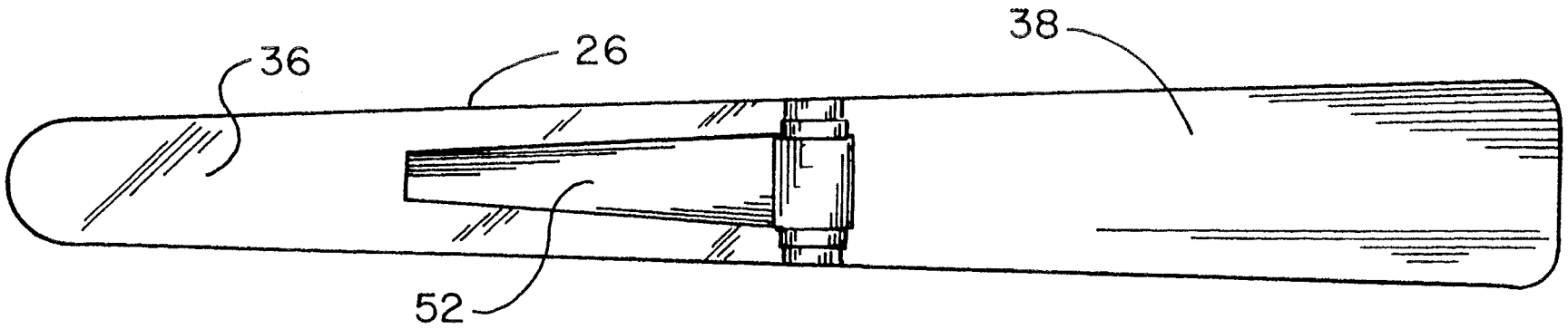
FIG. 5 is a top elevational view of the lower component of the device shown in FIG. 3.
Figure 6:
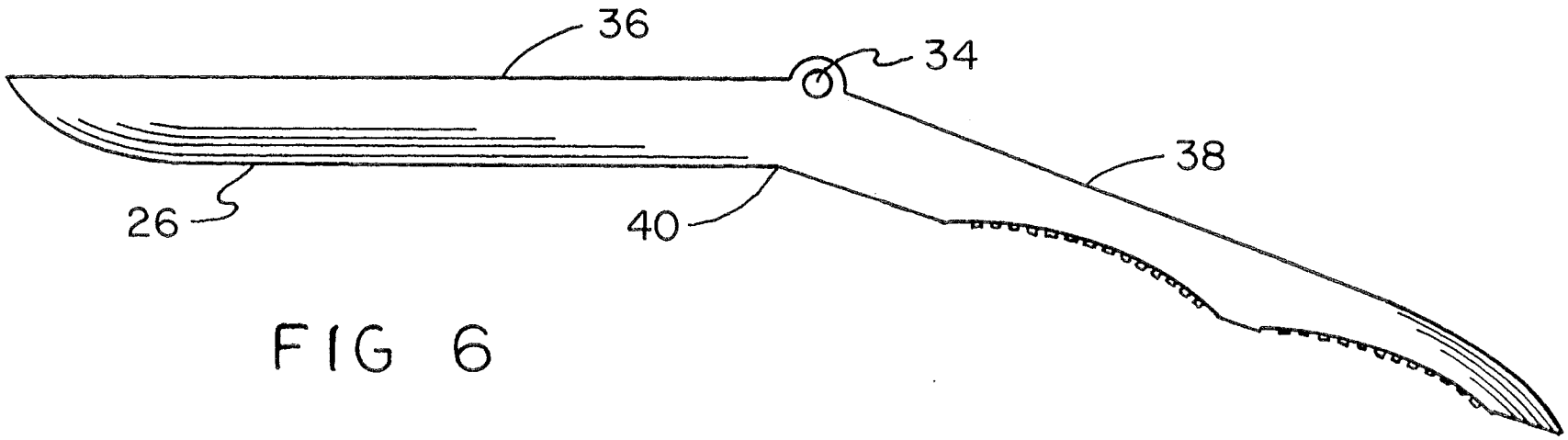
FIG. 6 is a side elevational view of the device shown in FIG. 5.
Figure 7:
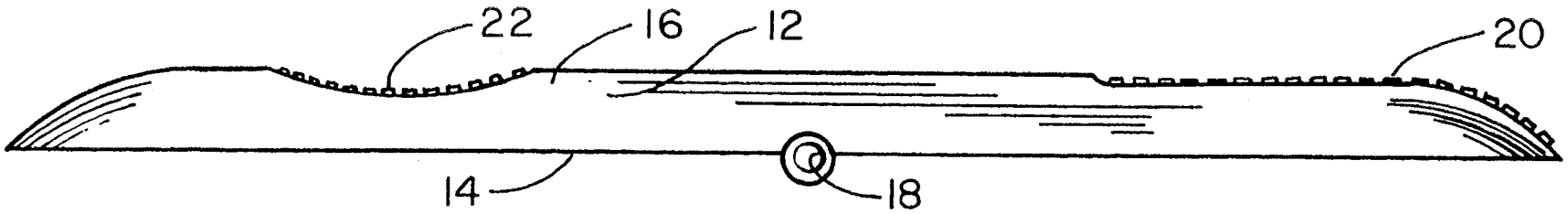
FIG. 7 is a side elevational view of the upper component of the device shown in FIG. 3.
Figure 8:
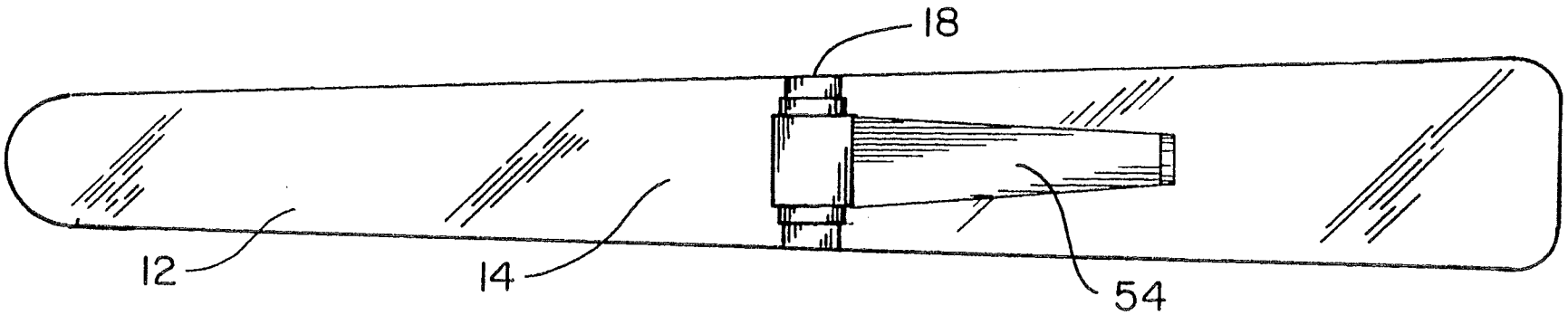
FIG. 8 is a bottom elevational view of the device shown in FIG. 7.

With reference now to the drawings, and in particular to FIG. 1 thereof, the preferred embodiment of the new and improved apparatus for removing nail polish while precluding contact with harsh chemicals and skin irritants embodying the principles and concepts of the present invention and generally designated by the reference numeral 10 will be described.

The present invention, the new and improved apparatus for nail polish while precluding contact with harsh chemicals and skin irritants is comprised of a plurality of components. Such comprise a first upper component, a second upper component, a coil spring and removable attachment means coupled therebetween. Such components are individually configured and correlated with respect to each other so as to attain the desired objective.

More specifically, a central component of the present invention of the system 10 is a first or upper component 12. Such component is fabricated of a generally rigid material, preferably plastic but metal is acceptable. It is formed in an elongated configuration. Such first component has an essentially planar lower face 14. It also has an upper face 16 rounded in cross-section along its longitudinal axis. Formed at an intermediate extent thereof transverse to the longitudinal direction is a pivot aperture 18. Such pivot aperture extends laterally through the central extent of the first component to form a rearward extent and a rearward extent. The upper face of the first component is formed with a roughened thumb grip 20 at its rearward end of its rearward extent. In addition, the upper surface of the first component has a roughened finger grip 22 at a central portion of the forward extent.

Next provided is a second or lower component 26. Such lower component is of a generally linear configuration and fabricated of a generally rigid material like the first upper component. The second component has leading and trailing edges 30 and 32. Such edges are generally parallel with the leading and trailing edges of the first component during operation and use. The second component also has a pivot aperture 34 extending laterally through a central extent thereof. This divides the second lower component to form a forward extent and a rearward extent. The second component is also formed with planar upper surfaces 36 and 38 formed on the forward and rearward extents. An angle 40 is thus formed between the forward and rearward extents at an angle of between about ten and twenty degrees. Such angle is formed with respect to the two extents of the second lower components.

The forward extent of the lower component is positionable parallel with the lower planar surface of the first component when in a relaxed orientation. The rearward extent of the lower component is positionable parallel with the parallel surface of the first or upper component when being in the compressed orientation for grasping objects between the forward extents of the upper and lower components. The lower surface of the rearward extent is formed with a generally curved lower surface. A pair of longitudinally spaced finger receiving regions are formed therein.

Next provided is a coil spring 44. Such spring has a central coil 46 and a first linear member 48 and a second linear member 50 spaced and in opposite directions from the coil. The first linear member is positioned on the upper surface of the rearward extent of the second component. The second linear member is positioned on the upper surface of the rearward extent of the second component. The second liner member is positioned on the upper surface at the forward extent of the first component. A pair of attachment plates 52, and 54 are also provided for securing the liner members of the spring to the components that they are contacting.

The last component of the system 10 is attachment member 56. Such member extends through the pivot apertures of the first and second components and the central coil of the spring. In this manner, compressing together the rearward extents of the first and second components pull open the forward extents of the first and second components against the resilient urging of the spring. In this manner, cotton or other objects may be grasped thereby. Release of the finger pressure from the rearward extents of the first and second components will allow the return of the forward extents of the first and second components for the secure grasping of such objects to allow the remote manipulation thereof during operation and use.

The present invention is a convenient and practical tool used to remove unwanted nail polish without the danger of contact with harsh chemicals or skin irritants.

The present invention is a hand-held instrument approximately 4 inches in length. One straight handle and one angled handle are connected by a coil spring mechanism which allows one end of the tool to open when the angled end is compressed. The present invention is made from a durable plastic material and features a surgical stainless steel holding tip located at the clamping end. Three finger grips and one thumb grip are fitted onto the instrument for easy control and handling.

The angled handle and the straight handle are squeezed together, allowing the other end of the tool to open. Using a grip similar to that when holding a pen, the user clamps a cotton ball into the steel tip. The cotton is then dipped into the nail polish remover and administered to the unwanted polish. When the removal is completed, the user simply compressor the two ends together again to release and discard the used cotton ball.

Usage of the present invention will avoid unnecessary contact with potentially harmful chemicals found in nail polish removal liquids. It will then also allow the user to remove unwanted polish more precisely and effectively, without accidentally marring other finished nails.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved apparatus for removing nail polish while precluding contact with harsh chemicals and skin irritants comprising, in combination:

a first upper component fabricated of a generally rigid material in an elongated configuration, the first component having an essentially planar lower face and a upper face rounded along its longitudinal axis with a pivot aperture extending laterally through the central extent thereof to form a forward extent and a rearward extent, the upper face of the first component being formed with a roughened thumb grip at the rearward end of the rearward extent and a roughened finger grip at a central portion of the forward extent;

a second lower component of a generally linear configuration and fabricated of a generally rigid material, the second component having leading and trailing edges positionable parallel with the leading and trailing edges of the first component during operation and use, the second component having a pivot aperture extending laterally through a central extent thereof to form a forward extent and a rearward extent and with planar upper surfaces formed on the forward and rearward extents with at an angle of between about ten and twenty degrees formed with respect to the extents, the forward extent being positionable parallel with the lower surface of the upper component when in a relaxed orientation, the rearward extent positioned parallel with the lower surface of the upper component when in the compressed orientation, the lower surface of the rearward extent being formed with a generally curved lower surface with a pair of longitudinally spaced finger receiving regions;

a coil spring with a central coil and a first linear member and second linear member oppositely spaced, the first linear member being positioned on the upper surface of the rearward extent of the second component and the second linear member positioned on the upper surface at the forward extent of the first component with an attachment plate securing each of the linear members of the spring to its respective components; and removable attachment means extending through the pivot apertures of the first and second components and the central coil of the spring whereby compressing together the rearward extents of the first and second components will open the forward extents of the first and second components against the resilient urging of the spring while release of the pressure from the rearward extents of the first and second components will allow the return of the forward extents of the first and second components for grasping an object for the remote manipulation thereof.

2. An apparatus for removing nail polish comprising:

a first component of a generally rigid material in an elongated configuration, the first component having an essentially planar lower face and a upper face rounded along its longitudinal axis with a pivot aperture extending laterally through the central extent thereof, the upper surface of the first component being formed with a roughened thumb grip at its leading edge and a roughened finger grip at its trailing edge;

a second component of a generally linear extent and fabricated of a rigid material, the second component having a forward planar edge positionable parallel with the leading edge of the first component during operation and use, the second component having a second planar upper surface at an angle with respect to the first planar surface and positionable parallel with the rearward planar surface of the first component when in a compressed orientation, the second component being formed with a generally curved lower surface with a pair of longitudinally spaced finger receiving regions on its rearward section and a pivot aperture extending laterally through the central extent thereof; and resilient components between said first component and said second component.

3. The apparatus as set forth in claim 2 wherein the resilient components include a coil spring with a first linear member oppositely spaced from a second linear member, the first linear member being positioned on the upper surface of the forward section of the second member and the second linear member positioned on the upper surface at the rearward portion of the second linear member with an attachment plate securing each of the linear members of the spring to said first and second component.

4. The apparatus as set forth in claim 3 and further including removable attachment means through the pivot apertures of the first and second components and the central extent of the spring whereby compressing together the rearward ends of the first and second components will open the forward ends of the first and second components against the resilient urging of the spring while release of the pressure from the rearward ends of the first and second components will allow the return of the forward ends of the first and second components for grasping an object for the remote manipulation thereof.

* * * * *